United States Patent [19]

Barker et al.

[11] 4,159,028

[45] Jun. 26, 1979

[54] METHOD OF FORMING AND CONTAINERIZING A MULTIPHASE COSMETIC COMPOSITION

[75] Inventors: Patricia I. M. Barker, Apex; William D. Bulla, Jr., Raleigh; John J. Dragnett, Raleigh; Jimmy D. Harmon, Raleigh, all of N.C.

[73] Assignee: Almay, Inc., Apex, N.C.

[21] Appl. No.: 781,590

[22] Filed: Mar. 28, 1977

[51] Int. Cl.[2] ..... B65B 3/04

[52] U.S. Cl. ..... 141/9; 141/11; 366/150

[58] Field of Search ..... 141/9, 11, 104, 69, 141/105, 107, 164, 171, 263, 270, 279, 283, 284, 374, 392; 53/36; 222/145; 137/604; 259/88; 424/358; 366/150

[56] References Cited

U.S. PATENT DOCUMENTS

| | | | |
|---|---|---|---|
| 489,028 | 1/1893 | McKinley | 141/374 X |
| 3,267,971 | 8/1966 | Mueller | 141/9 |
| 3,297,061 | 1/1967 | Nimee | 141/9 |
| 3,559,700 | 2/1971 | Erickson | 141/9 |
| 3,949,791 | 4/1976 | Vadas | 141/164 |

*Primary Examiner*—Richard E. Aegerter
*Assistant Examiner*—Frederick R. Schmidt
*Attorney, Agent, or Firm*—Mills & Coats

[57] ABSTRACT

The present invention relates to a method of forming and containerizing a multiphase cosmetic composition such as for example, a cleansing cream-astringent composition comprised of a cream phase and a gel phase combined to form the cosmetic composition or product. The method disclosed herein basically entails directing at least two initially separate and distinct phase compositions to a dispensing head and simultaneously dispensing the at least two phase compositions from the dispensing head into an offset rotatively driven container. Initially the dispensing head is positioned about the lower portion of the container and once dispensing is commenced, the dispensing head is slowly moved vertically from the lower portion of the container to the top thereof and during this movement each phase of the multiphase compositions is simultaneously dispensed therefrom and a stirring effect is achieved by the rotating container and a plurality of stirring rods disposed about the dispensing head. Once filled, the multiphase cosmetic composition dispensed within the container assumes a generally swirled type or marble like configuration and appearance throughout the container with the respective phases being disposed in generally side-by-side relationship, stable, generally separate, and visually distinct.

6 Claims, 6 Drawing Figures

METHOD OF FORMING AND CONTAINERIZING A MULTIPHASE COSMETIC COMPOSITION

The present invention relates to cosmetic compositions, and more particularly to a method of forming and containerizing a multiphase cosmetic composition comprised of at least two distinct and separate phase compositions that once combined or blended together in a container form a final cosmetic composition, mix or product.

BACKGROUND OF THE INVENTION

The concept of a duophase or multiphase cosmetic composition is quite interesting inasmuch as such a composition has a potential for combining two or more functional cosmetic compositions into a single product that may be applied to a subject's face or body in one application. However, with any such multifunctional, multiphase cosmetic composition it is obviously important that the formed product be functional and effective and that such be maintained, preserved, and usable over a reasonable product life span.

One particular area of concern is in containerizing and packaging a multiphase cosmetic composition. Here, it is desirable that each of the phases comprising the total product be dispensed into a container such that the respective phases are generally maintained separately, remain stable, and that in viewing the product each phase, as packaged, is visually distinct. Of principal concern is that during the proposed life of a multiphase cosmetic product, respective phases comprising the total product do not blend and mix together such that the total product in the end is nearly or substantially homogeneous. In addition, in containerizing a multifunctional, multiphase cosmetic composition, it is important that the respective phases comprising the composition be dispensed in a manner such that the particular phases are present and occur throughout the final product such that in gathering a single application from a container, the subject is likely to gather an adequate amount of each respective phase.

SUMMARY OF THE INVENTION

The present invention relates to a method of forming and containerizing a multiphase cosmetic composition, with particular emphases placed on dispensing the respective phase compositions into a container such that each respective phase is generally maintained separately, remains stable, and is visually distinct. In particular, the method of containerizing a multiphase cosmetic composition, as disclosed herein, entails simultaneously directing each of the respective phases comprising the cosmetic composition to a dispensing head where each of the phases are simultaneously directed from the dispensing head into a container that is preferably skewed or axially slanted with respect to the dispensing head. During the dispensing operation, the container is rotatively driven and the dispensing head is slowly raised from a lower position to an upper position causing the respective phases to be dispensed in a swirl like configuration throughout substantially the entire volume of the container. During the dispensing of the respective phases into the container, there is provided an effective stirring action about the dispensing head which effectively stirs the cosmetic composition during the entire dispensing operation.

It is, therefore, an object of the present invention to provide a method of containerizing a multiphase cosmetic composition wherein each separate phase comprising the total composition is stabled and generally maintained separately within the total composition with blending and mixing between respective phases being minimized or essentially nonexisted.

Another object of the present invention is to provide a method for dispensing and containerizing a multiphase cosmetic composition such that respective phases comprising the total composition or product are dispensed to yield a multifunctional cosmetic composition that is pleasing in appearance.

A further object of the present invention resides in the provision of a method for forming and containerizing a multiphase cosmetic composition wherein respective phases are dispensed simultaneously into a rotatively driven container and effectively stirred while the dispensing operation is carried out such that the final composition or product comprised of the respective phases assumes a swirl type configuration within the container.

It is a further object of the present invention to provide a method for dispensing and containerizing a multiphase cosmetic composition within a container such that the respective phases comprising the multiphase cosmetic composition tend to remain generally separately disposed within the total composition and generally resist blending and mixing between respective phases that would give rise to a more homogeneous type total composition where the individual phases would lose their distinctiveness.

Other objects and advantages of the present invention will become apparent from a study of the following description and the accompanying drawings which are merely illustrative of the present invention.

Figure 1:
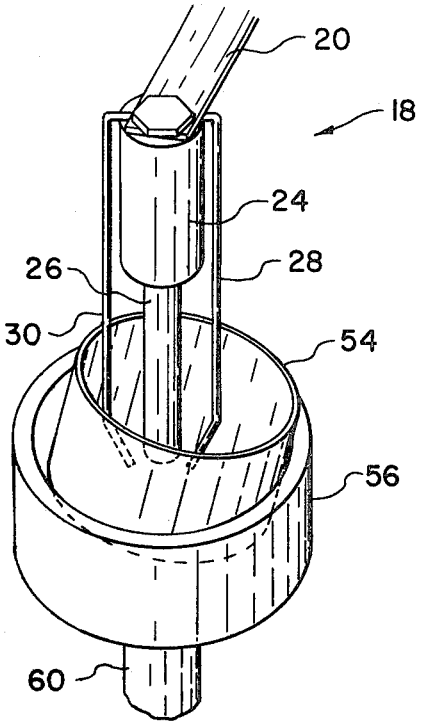
FIGS. 1 through 3 are sequence views illustrating the dispensing of a duophase cosmetic composition into a container, with FIG. 1 illustrating the relative position of the dispensing head and the underlying container during the beginning of a filling operation, FIG. 2 illustrating the relative position during an intermediate phase of the filling operation, and FIG. 3 illustrating the relative position of the dispensing head and the underlying container during the final phase of the filling operation.

The present invention relates to a method or process for forming and containerizing a multiphase or duophase cosmetic composition comprised of at least two separate phases that are combined together in such a form that the total composition includes at least two phases. As will become evident from subsequent portions of this disclosure, it is desirable to dispense and containerize the respective phases comprising the multiphase cosmetic composition in such a manner that each phase generally remains separate, stable and visually distinct.

Before proceeding with a discussion of the basic method of dispensing and containerizing a multiphase cosmetic composition, it might be beneficial to first consider the general composition of an example duophase cosmetic composition. In this regard, the following discussion will disclose what may properly be termed a duophase cosmetic cleansing cream that is the subject matter of a separate U.S. Patent Application concurrently filed with this application. This duophase cosmetic composition that is described subsequently is of a basic cleansing cream type and which particularly includes what is referred to as a cream phase and a gel phase that generally function as a cleanser and astringent respectively. In this duophase cosmetic cleansing cream composition, the cream phase is generally a water miscible cosmetic admixture and an emulsion and is basically comprised by weight of the following: an oil making up approximately 40–65% by weight or possibly as much as 10–80% by weight, water making up 35–65% or possibly as much as 20–70% by weight, a thickening agent generally making up approximately 0.25–3.70% by weight, and an emulsifier generally making up in the range of 1.0–9.0% by weight and preferably in the range of 2.00–4.00% by weight.

Briefly referring to the other phase of the cleansing cream composition, a gel phase is provided which may serve as an astringent or skin toner type function. In the gel phase, which may also be termed a water miscible cosmetic admixture, the same basically comprises water or a water soluble material that makes up generally about 60–95% by weight of the entire gel phase composition combined with a thickening agent which would generally make up about 0.50–4.00% by weight of the entire gel phase composition.

Set forth below are two separate formulation tables that outline the composition or solution make-up of both the cream and gel phase compositions with the formulation being set forth in each table by percentage of weight for the respective phase only, and not the total combined composition that results from the two phases being combined. It is noted that in setting forth the formulation a considered ideal formulation range is shown in which case it is expected that an effective and feasible result or product can be produced within the range set forth. Also, an example formulation is listed. Finally, each table includes a major range that is contemplated for each material set forth in forming a part of the cream and gel phases.

CREAM PHASE

| MATERIAL | FURTHER DESCRIPTION WHERE APPLICABLE | FORMULATION (PERCENT BY WEIGHT OF CREAM PHASE) MAJOR RANGE CONTEMPLATED | CONSIDERED IDEAL RANGE | AN EXAMPLE FORMULATION |
|---|---|---|---|---|
| Cleansing Oil | Mineral Oil or substitute or partial substitute including isopropyl myristate, isopropyl palmitate, decyl oleate, or isodecyl oleate | 10.00–80.00 | 40.00–65.00 | 60.000 |
| Water | | 20.00–70.00 | 25.00–50.00 | 32.796 |
| Thickening Agent | Carbomer 934 | 0.25–1.70 | 0.40–1.00 | 0.500 |
| | Carbomer 941 | 0.00–2.00 | 0.03–0.80 | 0.060 |
| Emulsifier | Polysorbate 20 | 1.00–9.00 | 2.00–4.00 | 2.400 |
| Preservative | Methyl-p-hydroxy Benzoate | 0.10–0.40 | 0.20–0.30 | 0.200 |
| | Imidazolidnyl Urea | 0.10–0.50 | 0.20–0.34 | 0.300 |
| | Propyl-p-hydroxy Benzoate | 0.05–0.40 | 0.05–0.15 | 0.050 |
| Humectant | Propylene Glycol | 0.00–15.00 | 2.00–8.00 | 3.000 |
| UV Light Inhibitor | Benzophenone-4 | 0.00–0.20 | 0.05–0.10 | 0.050 |
| Sequestering Agent | Trisodium EDTA | 0.00–0.40 | 0.03–0.10 | 0.050 |
| Color | Red No. 19 Solution | 0.001–0.50 | 0.01–0.15 | 0.073 |
| | Yellow No. 5 Solution | 0.001–0.50 | 0.01–0.15 | 0.021 |
| Neutralizer | Triethanolamine | 0.15–3.00 | 0.30–0.80 | 0.500 |
| TOTAL | | | | 100.000 |

GEL PHASE

| MATERIAL | FURTHER DESCRIPTION WHERE APPLICABLE | FORMULATION (PERCENT BY WEIGHT OF GEL PHASE) MAJOR RANGE CONTEMPLATED | CONSIDERED IDEAL RANGE | AN EXAMPLE FORMULATION |
|---|---|---|---|---|
| Water or Water Soluble Material | | 50.00–99.00 | 80.00–95.00 | 90.867 |
| Thickening Agent | Carbomer 934 | 0.50–2.00 | 0.70–1.30 | 1.040 |
| | Carbomer 941 | 0.00–2.00 | 0.05–0.50 | 0.150 |
| Humectant | Propylene Glycol | 0.00–15.00 | 2.00–8.00 | 5.000 |
| Emulsifier | Choleth-24 | 0.00–5.00 | 0.50–2.00 | 1.000 |
| Preservative | Methyl-p-hydroxy Benzoate | 0.10–0.40 | 0.20–0.30 | 0.200 |
| | Propyl-p-hydroxy | 0.05–0.40 | 0.05–0.15 | 0.050 |

-continued

| | | | | |
|---|---|---|---|---|
| | Benzoate | | | |
| | Imidazolidnyl Urea | 0.10–0.50 | 0.20–0.35 | 0.300 |
| Color | Red No. 19 Solution | 0.001–0.50 | 0.01–0.15 | 0.065 |
| | Yellow No. 5 Solution | 0.001–0.50 | 0.01–0.15 | 0.028 |
| Neutralizer | Triethanolamine | 0.15–4.00 | 0.70–1.60 | 1.200 |
| Sequestering Agent | Trisodium EDTA | 0.00–0.40 | 0.03–0.10 | 0.050 |
| UV Light Inhibitor | Benzophenone-4 | 0.00–0.20 | 0.05–0.10 | 0.050 |
| TOTAL | | | | 100.000 |

Figure 6:
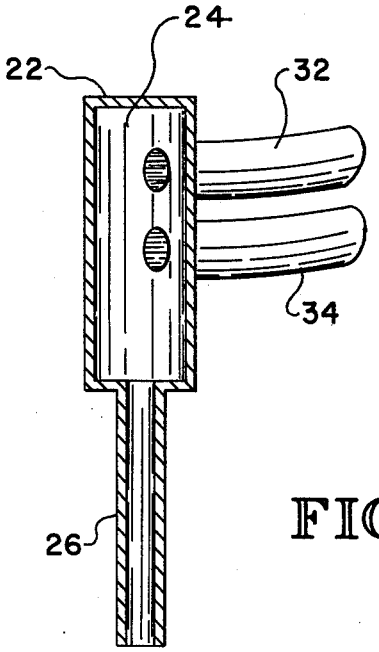
FIG. 6 is a side sectional view of the dispensing head illustrating two inlet lines thereto that allow respective phases of a duophase cosmetic composition to be directed to the dispensing head where the same is dispensed therefrom into the container.

Now turning to the drawings, particularly FIG. 6, a cosmetic filling and dispensing apparatus is shown therein and indicated generally by the numeral 10. Reviewing dispensing apparatus 10 in more detail, it is seen that the same comprises a platform 12 having an upstanding guide shaft 14 secured thereto with a dispensing collar 16 slidably contained on guide shaft 14. Secured to dispensing collar 16 and extending therefrom is a duophase dispensing head, indicated generally by the numeral 18.

Reviewing the dispensing head 18, it is seen that the same includes an arm 20 fixed to dispensing collar 16 and movable therewith and a dispensing nozzle 22 that basically comprises an upper receiving cavity 24 and a lower dispensing snout 26, as particularly illustrated in FIG. 6. In the case of a cosmetic composition such as the duophase cleansing cream composition outlined and discussed above, the receiving cavity 24 is communicatively connected with two inlet lines 32 and 34, each inlet line being adapted to convey and carry a separate phase, either the cream phase or the gel phase in the care of the example duophase cosmetic composition, from a source container to the receiving cavity 24 where the respective phases enter the dispensing nozzle 22 and move downwardly therefrom through the dispensing snout 26.

For controlling the flow of respective phase compositions to the dispensing head and for providing other basic controls for the dispensing apparatus 10, there is provided a controller indicated generally by the numeral 36 in FIG. 6. Controller 36 is not dealt with in detail as such controller units are known in the art and are conventional in other such dispensing machinery. In effect, controller 36 during the dispensing operation acts to control the flow of respective cosmetic composition phases through the respective inlet lines 32 and 34 that lead from the phase source to the receiving cavity 24.

During the filling operation of a container or receptacle 54, it is desirable to provide relative vertical movement between the container 54 and the dispensing head 18. To achieve this in the apparatus shown in the preferred embodiment of FIG. 5, there is provided an actuating lever 38 that is pivotably connected about one end to the dispensing collar 16 and is supported intermediately between the opposite end portions by a support post 42 through a pivot pin type connection that extends through a lost motion slot 40 formed in the lever 38. This, of course, allows the lever 38 to rotate about the axis of the pivot pin supported by the support post 42 even though the dispensing collar 16 always remains about the upright guide shaft 14.

It will be appreciated by those skilled in the art that relative vertical movement between the container 54 and the dispensing head 18 may be achieved in various ways. For example, the lever 38 could be actuated purely in a mechanical manner or by fluid pressure such as could be provided by a hydraulic actuating system. However, in the case of the present embodiment illustrated in FIG. 6, there is provided an actuator assembly 44 that is operatively connected to a rear end portion of the lever 38 and which is operative to oscillate the dispensing collar 16 up and down the guide shaft 14.

Figure 5:
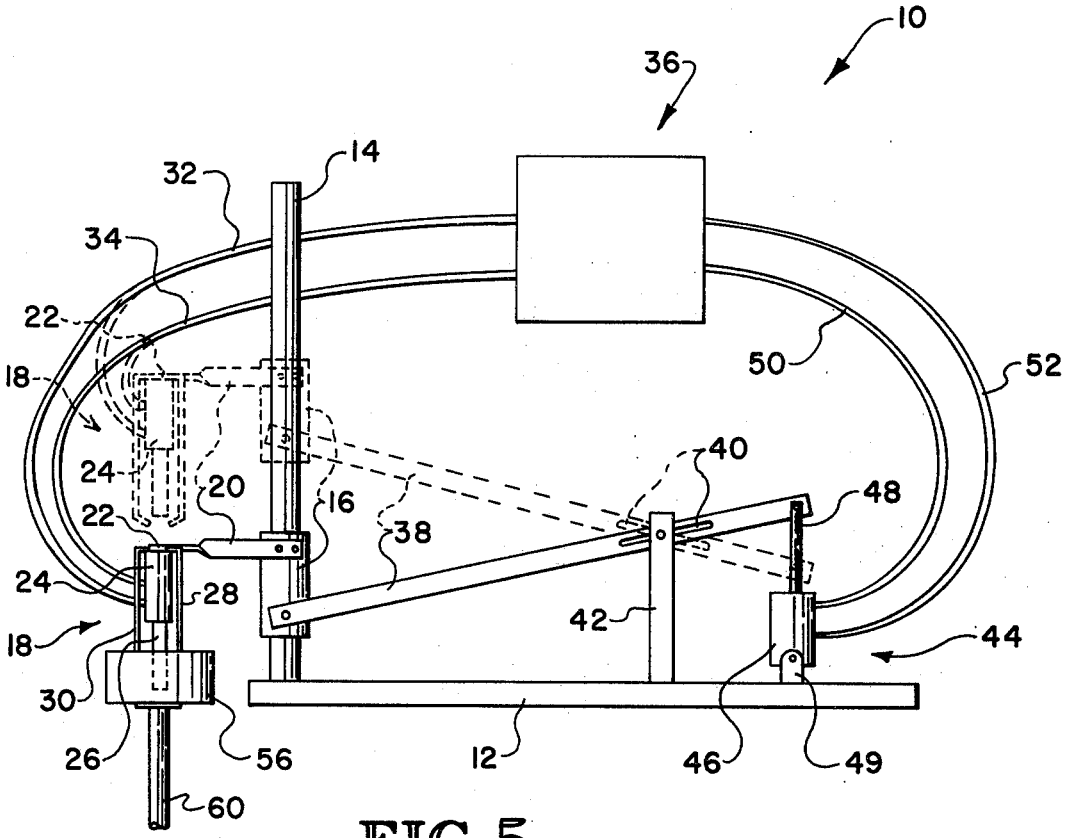
FIG. 5 is a fragmentary view of a basic filling apparatus utilized to dispense and containerize a cosmetic composition within a container, and wherein the vertically movable dispensing head forming a part of the filling apparatus is particularly shown.

Viewing the actuator assembly 44 of FIG. 5, it is seen that the same is basically a double acting air actuated piston assembly that again is controlled from a controller such as controller 36. The actuator assembly does include a housing 46 that is rotatively supported about a transverse axis by a yoke support 49 that is in turn supported by the platform 12 of the dispensing apparatus 10. Contained within housing 46 is a double acting piston (not shown) that is actuated up and down in the housing 46 by air that is controlled and directed to and from the cylindrical area within the housing 46 via two air conveying lines 50 and 52 that extend between the housing 46 and the controller 36. Controller 36 would be designed and adapted to control the flow of air through lines 50 and 52 to and from the housing 46 to actuate the internal piston (not shown) therein such that the dispensing head 18 would move vertically up and down in accordance with a designed or programmed dispensing action.

Figure 3:
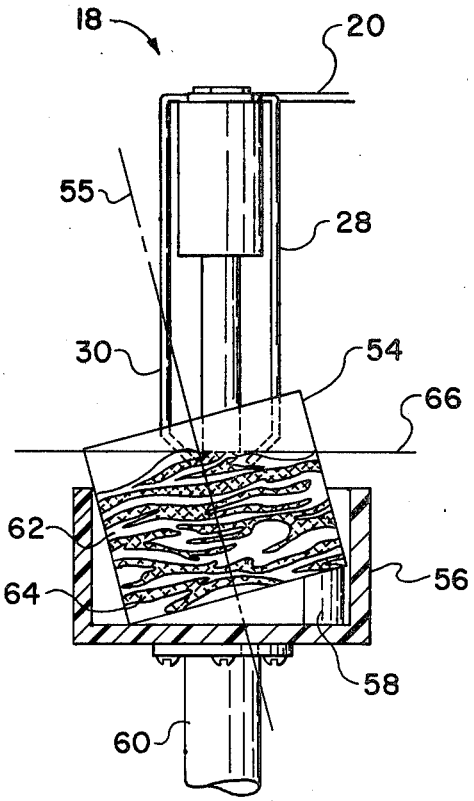
Figure 4:
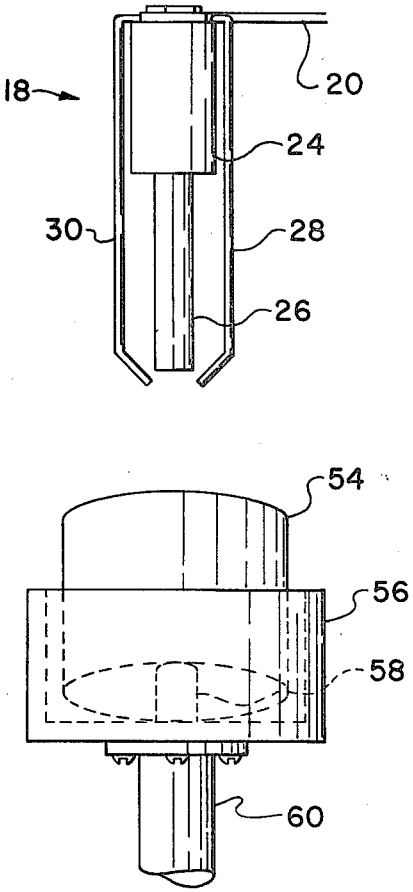
FIG. 4 illustrates the dispensing head in a raised position with respect to the underlying container.

The container or cosmetic receptacle 54 is supported generally underneath the dispensing head 18 and aligned therewith by a container or jar receptacle 56. A drive shaft 60 is operatively connected to the container receptacle 56 and is driven by an electric motor or other type of power source such that the container 54 supported therein is rotatively driven during the dispensing operation. In a preferred process or method for filling the container 54, a wedge or block 58 is disposed or interposed between the bottom of the container 54 and the container receptacle 56 such that the container is supported in an offset or axially skewed relationship with respect to the dispensing head 18, as generally illustrated in FIGS. 3 and 4. In such a skewed relationship, as illustrated in FIG. 3, it is seen that the container 54 and its major axis 55 is angled with respect to line 66 shown in FIG. 3 and referred to as the plane of the dispensing level which is generally coexistent with the plane of the terminal end of the dispensing snout 26 and generally perpendicular to the vertical axis of the dispensing nozzle 22. It is appreciated that in the case of a multiphase cosmetic composition having more than two respective phases that an inlet tube or channel for each phase would lead into the receiving cavity 24 of the nozzle 22.

Figure 2:
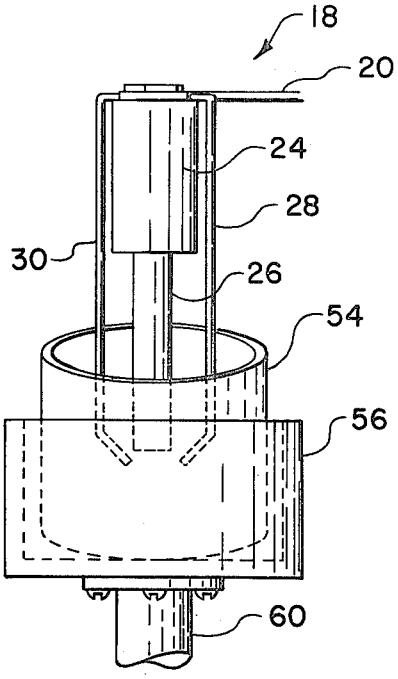

In containerizing a multiphase cosmetic composition such as the duophase cleansing cream composition discussed above, the container or jar 54 is placed on the container receptacle 56 and the dispensing head 18 is lowered to where the lower terminal end portion of the dispensing snout 26 is placed closely adjacent the lower portion of the container 54. Drive shaft 60 is rotatively driven causing the jar or container 54 to likewise be rotated in an offset or skewed relationship with respect to the dispensing head as shown in FIGS. 1–3. The dispensing operation is commenced by the controller 36 which functions to control the flow of each respective composition phase through anyone of a plurality of inlet lines, such as lines 32 and 34, into the receiving cavity 24 of the nozzle 22. Once in the receiving cavity 24, the respective phase compositions move downwardly therefrom through the dispensing snout 26 to where the compositions are dispensed from the nozzle 22 into the container or jar 54.

In the embodiment illustrated, controller 36 also functions to move the dispensing head 18 upwardly during the filling operation such that the final composition or product mix comprised of the respective phases extends throughout the container or jar from side to side and from bottom to top. Controller 36 is preferably designed and adapted to shut off the flow of material through the inlet lines 32 and 34 in response to the dispensing head 18 reaching a certain position with respect to the jar or container that is calculated to occur once the particular container is filled.

During the filling operation, the rotation of the container 54 results in the individual phases forming the total composition or product being dispensed in a swirl or circular pattern throughout the container 54. It is noted that a stirring action is achieved by the presence of the stirring rods 28 and 30 that depend downwardly adjacent the dispensing head.

The presence of the stirring rods, the offset or skewed relationship of the container 54 with respect to the dispensing head 18, the rotation of the container 54, and the upward movement of the dispensing head 18 during the filling operation results in the individual respective phases being dispensed in side-by-side relationship throughout substantially the entire volume of the container 54 with each respective phase being generally stable, and disposed such that each phase remains visually distinct.

As seen in FIG. 3, the resultant swirl type configuration is generally illustrated therein with the cream phase being referred to by the numeral 62 while the gel phase is referred to by the numeral 64. It is noted that the general size of each respective phase may vary from as small as one-sixteenth of an inch by one-sixteenth of an inch, to approximately one inch in diameter. It is important to realize that it is desirable that the respective phases to be dispersed throughout the composition such that in gathering a normal application the composition gathered would include an adequate amount of each phase that when rubbed together prior to application could be blended and mixed into a homogeneous or near homogeneous composition.

Finally, as noted hereinabove, it is thought to be preferable for the container 54 to be offset or disposed such that its major axis 55, that axis that runs perpendicular to the bottom of the container, to be skewed at an angle with respect to the dispensing head 18. To better illustrate this, line 66 drawn in FIG. 3 represents the plane of the dispensing head and such is generally perpendicular to the longitudinal or vertical axis of the nozzle 20. It is seen that the top of the container 54 would lie in a plane that would be angled with respect to line 66, or at least not parallel therewith which would be the case if the bottom of the container 54 were disposed on a generally flat planar surface that would lie substantially perpendicular to the vertical axis of the nozzle 22.

From the foregoing specification, it is seen that the present invention entails a method for forming and dispensing a multiphase cosmetic composition into a container such that the individual respective phases comprising the composition are dispensed in a swirl like configuration such that each respective phase remains generally separately disposed within the container and is visually distinct. This particular type of dispensing provides a very functional cosmetic composition or product and yet the manner of dispensing yields a resultant configuration or dispensing pattern that promotes the effectiveness of the cosmetic composition as well as contributing to the effective life of the product.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A method of forming, producing and containerizing a multiphase cosmetic composition comprised of at least two distinct cosmetic phase compositions, said method comprising:

(a) forming a cream phase cosmetic composition by combining an emulsifier, a thickening agent, an oil phase, and water;

(b) forming a gel phase cosmetic composition by combining a thickening agent and a water soluble material;

(c) directing the cream and gel phase compositions to a dispensing head;

(d) simultaneously dispensing the cream and gel cosmetic phase compositions into a container such that the respective cosmetic composition phases dispensed remain generally separate and distinct once in the container;

(e) providing relative rotational movement between said dispensing head and said container during dispensing such that the cream and gel phase compositions are dispensed in side-by-side relationship in a generally swirl configuration throughout the container;

(f) providing relative vertical movement between said dispensing head and said container such that the container is filled from the bottom to the top with the cream and gel phase compositions being dispensed in a swirl type configuration throughout; and (g) effectively stirring the dispensed cosmetic composition formed by said cream and gel phase compositions during the dispensing operation by rotating said container about at least one stirring rod disposed outwardly of said dispensing head during the dispensing operation.

2. The method of forming and containerizing a multiphase cosmetic composition of claim 1 wherein the method further includes the step of angling and disposing said container relative to said dispensing head such that a central axis of said container that extends generally perpendicular to a bottom of said container extends in a skewed relationship relative to said dispensing head.

3. The method of forming and containerizing a multiphase cosmetic composition of claim 1 further including angling said container relative to said dispensing head such that the plane of the container bottom is angled relative to the plane of the dispensing level of said dispensing head.

4. The method of forming and containerizing a multiphase cosmetic composition of claim 1 wherein effectively stirring the dispensed cosmetic composition during the dispensing operation includes rotating said container about at least one stirring rod disposed about said dispensing head such that the lower terminal ends of said one or more stirring rods is angled inwardly towards the area of dispensing of said dispensing head.

5. The method of forming and containerizing a multiphase cosmetic composition of claim 1 wherein providing relative rotational movement between said dispensing head and said container includes rotating the container while the container is stationed under said dispensing head in a position for receiving the distinct phase compositions being dispensed thereby; and wherein the step of providing relative vertical movement between said dispensing head and said container includes initially positioning said dispensing head adjacent the bottom of said container and once the dispensing operation has begun then moving said dispensing head generally vertical from the bottom area of said container towards the top while said distinct phase compositions are being dispensed from said dispensing head into said container.

6. A method of producing, forming and containerizing a multiphase cosmetic composition comprised of at least two distinct phase compositions, said method comprising:

(a) forming a cream phase cosmetic composition by combining an emulsifier, a thickening agent, an oil phase, and water;

(b) forming a gel phase cosmetic composition by combining a thickening agent and a water soluble material;

(c) directing the cream and gel phase compositions to a dispensing head;

(d) dispensing the cream and gel phase compositions simultaneously into a container;

(e) angling and disposing said container such that the major axis thereof is angled and skewed relative to said dispensing head during the dispensing operation;

(f) rotating said container while the cream and gel phase compositions are being dispensed therein such that the respective phase compositions are dispensed in side-by-side relationship in a generally swirl like configuration throughout the container;

(g) beginning the dispensing of said cream and gel phases with said dispensing head being positioned about a lower portion of the container and after dispensing begins for a particular container moving said dispensing head generally upwardly from a lower portion of the container to a top portion thereof while dispensing the cream and gel phase compositions from the dispensing head such that the container is filled from the bottom to the top and that the generally swirl configuration exists throughout the filled container; and (h) effectively stirring the dispensed cosmetic composition formed by said cream and gel phase compositions during the dispensing operation by rotating said container about at least one stirring rod disposed about the dispensing head during the dispensing operation.

* * * * *